US007776813B2

(12) United States Patent
Zhang et al.

(10) Patent No.: US 7,776,813 B2
(45) Date of Patent: Aug. 17, 2010

(54) FABRIC CARE COMPOSITIONS COMPRISING POLYOL BASED FABRIC CARE MATERIALS AND DEPOSITION AGENTS

(75) Inventors: Shulin Larry Zhang, West Chester, OH (US); Glenn Thomas Jordan, IV, Indian Springs, OH (US); Eric Christopher Wells, West Chester, OH (US); Joseph Dean Heatherly, Morrow, OH (US); Vicente Santamarina, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 602 days.

(21) Appl. No.: 11/224,874

(22) Filed: Sep. 13, 2005

(65) Prior Publication Data

US 2006/0058214 A1 Mar. 16, 2006

Related U.S. Application Data

(60) Provisional application No. 60/610,047, filed on Sep. 15, 2004.

(51) Int. Cl.
*C11D 3/37* (2006.01)

(52) U.S. Cl. ..... 510/475

(58) Field of Classification Search ..... 510/475
See application file for complete search history.

(56) References Cited

U.S. PATENT DOCUMENTS

| | | | | |
|---|---|---|---|---|
| 5,447,643 | A | 9/1995 | Kelkenberg et al. | |
| 5,756,446 | A | 5/1998 | Bator et al. | |
| 6,410,501 | B1 | 6/2002 | Jones et al. | |
| 6,436,896 | B2 | 8/2002 | Charlton et al. | |
| 6,486,120 | B1 | 11/2002 | Porta et al. | |
| 6,514,931 | B2 | 2/2003 | Grainger et al. | |
| 7,320,184 | B2 * | 1/2008 | Zhang et al. | 34/597 |
| 2001/0006938 | A1 | 7/2001 | Grainger et al. | |
| 2001/0018410 | A1 | 8/2001 | Grainger et al. | |
| 2001/0027173 | A1 | 10/2001 | Conroy et al. | |
| 2001/0034315 | A1 | 10/2001 | Grainger et al. | |
| 2002/0132886 | A1 | 9/2002 | Meffert et al. | |
| 2003/0181346 | A1 | 9/2003 | Harichian et al. | |
| 2004/0014626 | A1 | 1/2004 | Oses et al. | |
| 2005/0022311 | A1 | 2/2005 | Zhang et al. | |

FOREIGN PATENT DOCUMENTS

| | | | |
|---|---|---|---|
| EP | 0 832 968 | A1 | 1/1998 |
| GB | 1 469 124 | | 3/1977 |
| WO | WO 96/15213 | A1 | 5/1996 |
| WO | WO 97/15651 | A1 | 5/1997 |
| WO | WO 98/16538 | A1 | 4/1998 |
| WO | WO 00/70004 | A1 | 11/2000 |
| WO | WO 00/70005 | A1 | 11/2000 |
| WO | WO 01/07546 | A1 | 2/2001 |

* cited by examiner

*Primary Examiner*—John R Hardee
(74) *Attorney, Agent, or Firm*—James F. McBride; Leonard W. Lewis; Steven W. Miller

(57) ABSTRACT

A composition comprises polyol-based fabric care materials, particularly esterified saccharides. The composition further comprises deposition agents, dispersing medium, and optional adjunct ingredients. The compositions of the present invention are used to treat fabrics to provide one or more of the following benefits: fabric softness, wrinkle reduction after drying, ease of ironing, in-wear shape retention, fabric elasticity, fabric tensile strength, fabric tear strength, and color protection. Various products containing the composition and methods for using the composition are also disclosed.

11 Claims, No Drawings

FABRIC CARE COMPOSITIONS COMPRISING POLYOL BASED FABRIC CARE MATERIALS AND DEPOSITION AGENTS

CROSS REFERENCE TO RELATED APPLICATIONS

This application claims the benefit of U.S. Provisional Application Serial No. 60/610,047, filed on Sep. 15, 2004.

FIELD OF INVENTION

The present invention relates to a composition comprising polyol-based fabric care materials and deposition agents. The compositions are used to treat fabrics such that treated fabrics exhibit one or more of the following benefits: provide improved fabric softness, wrinkle reduction after drying, ease of ironing, in-wear shape retention, fabric elasticity, fabric tensile strength, fabric tear strength, and color protection. Various products containing the composition and methods for using the composition are also disclosed.

BACKGROUND OF THE INVENTION

Fabric care compositions, including fabric softening compositions, can be used during the rinse cycle or drying cycle of a typical laundry process to provide improved softness and freshness to the fabrics being laundered. If employed during the rinse cycle, the fabric care compositions are typically in the form of liquid compositions. If employed during the drying cycle, the fabric care compositions are typically in the form of solid or semi-solid compositions incorporated onto a nonwoven substrate.

Most common fabric care compositions can provide different degree of benefits such as fabric softening, fabric lubrication, fabric relaxation, wrinkle reduction, ease of ironing, abrasion resistance, fabric smoothing, static reduction and perfuming. Common fabric care materials in fabric care compositions are alkyl-modified quaternary ammonium compounds (also known as "alkyl quats") such as diester quaternary ammonium compounds (DEQA); polyquaternary ammonium compounds; triethanolamine esterified with carboxylic acid and quaternized (also known as "esterquat"); amino esterquats; cationic diesters; betaine esters; betaines. Additional actives include silicones or silicone emulsions comprising aminosilicones, cationic silicones, quat/silicone mixtures; functionalized PDMS. Certain disadvantages are associated with fabrics treated with these actives, including a soft but greasy feel, reduced water absorbency, yellowing upon aging. In addition, some of these actives do not have the desirable profiles in the area of biodegradability and toxicity.

In developing fabric care compositions, the primary focus is on the proper functions of the actives such that the treated fabrics exhibit the desired fabric care benefits. Through-the-rinse applications pose additional challenges in the area of effective deposition from the rinse medium to the fabrics. In some cases, it is found that fabric care actives having cationic moieties and long alkyl chains (e.g., alkyl quats) are very sensitive to certain detergent components (e.g., anionic surfactant) carried over from the wash cycle into the rinse cycle. It is hypothesized that the anionic detergent components may interact with the cationic fabric care actives, forming cationic-anionic complexes that may precipitate out of the rinse medium and/or neutralize the softening actives, the former reduces deposition onto fabrics and the latter reduces effectiveness of the fabric care actives.

Fabric care compositions comprising actives derived from plant/agricultural sources have been disclosed. Examples of naturally derived fabric care actives include sugar and vegetable oil derivatives. Fabric care actives derived from these natural sources are believed to be more environmentally friendly and more cost effective than petroleum derived fabric care actives, such as alkyl quats, ester quats, silicones. To ensure effective deposition onto fabrics, these fabric care actives may be used in combination with other co-actives or deposition agents. Exemplary compositions comprising naturally derived fabric care actives and deposition aids are disclosed in GB 1 601 359; U.S. Pat. Nos. 5,447,643; 5,498,350; 6,410,501; 6,436,896; 6,514,931; WO 98/16538; WO 01/034315; and WO 98/16538.

There is a continuing need to improve fabric care compositions to deliver efficient deposition and enhanced fabric care benefits of. There is also a continuing need to develop fabric care compositions especially for laundry applications requiring deposition during the wash cycle and/or the rinse cycle. There is a further need to develop fabric care composition comprising effective deposition agents suitable for the plants based fabric care actives.

SUMMARY OF THE INVENTION

One aspect of the present invention relates to a fabric care composition comprising:

(a) a polyol-based fabric care material;

(b) a deposition agent selected from the group consisting of I) non-quaternary nitrogen-containing compounds, II) non-polysaccharide polyquaterniums and other polymeric cationic quaternary materials, and mixtures thereof; and (c) a dispersing medium.

Another aspect of the present invention relates a product comprising the fabric care composition and a carrier substrate.

Another aspect of the present invention relates to a product comprising the fabric care composition and an effective amount of a carrier material such that the product has a melting temperature or softening temperature above 95° C.

Another aspect of the present invention relates to methods of treating fabrics to provide one or more benefits selected from the group consisting of fabric softening, fabric lubrication, fabric relaxation, durable press, wrinkle resistance, wrinkle reduction, ease of ironing, abrasion resistance, fabric smoothing, anti-felting, anti-pilling, crispness, appearance enhancement, appearance rejuvenation, color protection, color rejuvenation, anti-shrinkage, in-wear shape retention, fabric elasticity, fabric tensile strength, fabric tear strength, static reduction, water absorbency or repellency, stain repellency, refreshing, anti-microbial, odor resistance. The method comprises the step of contacting the fabrics with an effective amount of a fabric care composition of the present invention; the contacting step can occur during the wash cycle, the rinse cycle, the drying cycle, and combinations thereof.

Another aspect of the present invention relates to the use of the present compositions and/or product to provide one or more fabric care benefits selected from the group consisting of fabric softening, fabric lubrication, fabric relaxation, durable press, wrinkle resistance, wrinkle reduction, ease of ironing, abrasion resistance, fabric smoothing, anti-felting, anti-pilling, crispness, appearance enhancement, appearance rejuvenation, color protection, color rejuvenation, anti-shrinkage, in-wear shape retention, fabric elasticity, fabric tensile strength, fabric tear strength, static reduction, water absorbency or repellency, stain repellency, refreshing, anti-microbial, odor resistance.

DETAILED DESCRIPTION OF THE INVENTION

Definitions

As used herein, "fabric article" means an article composed of fabrics and/or fibers. Such articles include, but are not limited to, clothing, towels and other bath linens, bed linens, table cloths, carpets, curtains, upholstery coverings, sleeping bags, tents, shoes, and car interior (such as car seat covers, car floor mats).

As used herein, "fabric care active" means a material or combination of materials that can deliver one or more of the following benefits to a fabric article: fabric softening, fabric lubrication, fabric relaxation, durable press, wrinkle resistance, wrinkle reduction, ease of ironing, abrasion resistance, fabric smoothing, anti-felting, anti-pilling, crispness, appearance enhancement, appearance rejuvenation, color protection, color rejuvenation, anti-shrinkage, in-wear shape retention, fabric elasticity, fabric tensile strength, fabric tear strength, static reduction, water absorbency or repellency, stain repellency, refreshing, anti-microbial, odor resistance, and mixtures thereof.

As used herein, the terms "fabric care material", "fabric care active" and "benefit agents" are synonymous.

As used herein, "fabric treatment composition" means a composition that comprises one or more fabric care materials, or one or more perfume materials, or combinations thereof. Suitable forms of treatment compositions include liquids, such as solutions, emulsions or suspensions, and solids, such as particles, powders, tablets or bars.

As used herein, the terms "fabric treatment composition", "fabric care composition" and "benefit composition" are synonymous.

As used herein, "deposition agents" are materials that enhance or enable the deposition of fabric care materials on fabric article to provide the desired benefits. The "deposition agents" can be chemicals or compounds that are cationically modified by quaternized amines thus carry "permanent" cationic charge(s), or can potentially carry cationic charge(s) or polarity in the use medium through protonation of nitrogen atoms present in the compounds.

As used herein, "molecular weight" of a polymer means the weight-average molecular weight, as measured by Gel Permeation Chromatography (GPC).

As used herein, the articles "a" and "an", when used in a claim, are understood to mean one or more of the material that is claimed or described.

Unless otherwise indicated, all percentages and ratios are calculated based on weight of the total composition.

Unless otherwise noted, all component or composition levels are in reference to the active level of that component or composition, and are exclusive of impurities, for example, residual solvents or by-products, which may be present in commercially available sources.

Fabric Treatment Composition and Product

The fabric treatment composition of the present invention comprises a polyol-based fabric care material, a deposition agent, a dispersing medium, and optionally, one or more auxiliary materials (such as fabric care actives and adjunct materials).

In one embodiment, the fabric treatment composition comprises a polyol-based fabric care material, particularly esterified saccharides such as sucrose esters; a deposition agent such as polymers that are cationically modified or can be protonated or bear cationic charge in the use medium; a dispersing medium, such as water, alcohols, diols; and optionally, one or more auxiliary materials selected from the group consisting of softening agents, perfumes, wetting agents, emulsifiers, emulsion stabilizing agents, viscosity modifiers, pH buffers, antibacterial agents, antioxidants, radical scavengers, chelants, antifoaming agents, and mixtures thereof.

In another embodiment, the fabric treatment composition comprises from about 1% to about 70% by weight of the composition of a polyol-based fabric care material, from about 0.1% to about 20% by weight of the composition of a deposition agent, from about 30% to about 98% by weight of the composition of a dispersing medium, and optionally, the balance of one or more adjunct materials.

In another embodiment, the fabric treatment composition comprises a polyol-based fabric care material and a deposition agent having the weight ratio ranging from about 1000:1 to about 1:20, preferably from about 100:1 to about 1:1, more preferably from about 10:1 to about 2:1.

In another embodiment, the fabric treatment composition may be a solid or semi-solid comprising from about 1% to about 70% by weight of the composition of a polyol-based fabric care material, from about 0.1% to about 20% by weight of the composition of a deposition agent, and less than about 30% by weight of the composition of a dispersing medium, and optionally, the balance of one or more adjunct materials. In another embodiment, the dispersing medium comprises from about 0.01% to about 10%, or from about 0.1% to about 5%, by weight of the composition.

The present compositions can be liquid or solid, and are preferably liquid compositions. Liquid compositions of the present invention can be clear or opaque (dispersions or emulsions). The present compositions can also be provided in a unit dose form, for example, as a liquid composition contained in a water-soluble film (e.g. polyvinyl alcohol film) or as a solid tablet unit dose form. Exemplary water-soluble films and pouch products are described in U.S. Pat. No. 4,973,416 to Kennedy; U.S. 2003/0,050,208A1 to Duquest et al; and U.S. 2003/0,114,332A1 to Ramcharan et al.

The present compositions can also be dosed in the laundry process through other means such as hand pump, squeeze bottle, squeeze tube, bars, granules, particles or other forms that can be dispersed into the wash or rinse liquor with or without addition device.

The liquid compositions of the present invention can be used by manual pouring from a container and will typically have a viscosity in the range from a bout 1 cps (0.001 Pa·s) to about 2000 cps (2 Pa·s), preferably less than about 500 centipoises (0.5 Pa·s), more preferably less than about 200 centipoises (0.2 Pa·s), and even more preferably less than about 120 centipoises (0.12 Pa·s). For purposes of the present invention, the viscosities of the present compositions are measured at 25° C. with a Brookfield® viscometer using a No. 2 spindle at 60 rpm.

The compositions of the present invention will generally have a pH of from about 2 to about 9, preferably from about 2 to about 8, and more preferably from about 2 to about 7.

The compositions of the present invention can be used to treat fabrics during the wash cycle, rinse cycle, and/or drying cycle of a laundering process.

The present invention also relates to a product comprising the fabric care composition and a substrate, which is capable of releasing the fabric care composition in an automatic laundry dryer. Suitable substrates include flexible substrates composed of woven or nonwoven webs of polyolefin fibers or cellulosic fibers. These substrates are often referred to as the "dryer sheets". The fabric care compositions may be may be deposited on or otherwise incorporated into the substrates at an amount ranging from about 0.1 g to about 100 g, or from about 0.1 g to about 20 g, or from about 0.1 g to about 10 g. Exemplary dryer sheet containing fabric care compositions are described in U.S. Pat. No. 3,442,692 to Gaiser; U.S. Pat. No. 3,686,025 to Morton; U.S. Pat. No. 4,834,895 to Cook et al.; U.S. Pat. No. 5,041,230 to Borcher, Sr. et al.; and U.S. Pat. No. 5,145,595 to Morris et al.

The fabric care composition of the present invention can also be combined with an effective amount of a carrier material to form a fabric conditioning product having a melting temperature or softening temperature above the operating temperature of an automatic laundry dryer (typically above 90° C.). The melting temperature or the softening temperature of the fabric conditioning product can be above 95° C., or above 100° C. or above 120° C., and the melting temperature of the product can be below 200° C. The melting temperature of the fabric conditioning product is the temperature where the product becomes a flowable liquid; the melting temperature can be determined by a differential scanning calorimeter (DSC) or by visual observation. The softening temperature is the temperature at which the product becomes easily deformable; the softening temperature will be about 1-10 degrees lower than the melting temperature. Nonlimiting examples of carrier materials include ethylene bisamides, primary alkylamides, alkanolamides, polyamides, alcohols containing at least 12 carbon atoms, alkoxylated alcohols containing alkyl chain of at least 12 carbon atoms, carboxylic acids containing at least 12 carbon atoms, and derivatives thereof. Exemplary carrier materials and products comprising carrier materials and fabric care ingredients are described in U.S. 2003/1,195,130A1 to Lentsch et al.

Polyol-Based Fabric Care Materials

"Polyol", as used herein, means any aliphatic or aromatic compound containing at least two free hydroxyl groups. In practicing the processes disclosed herein, the selection of a suitable polyol is simply a matter of choice. For example, suitable polyols may have a backbone chain selected from the following classes: saturated or unsaturated, linear or branched or cyclic (including heterocyclic), aliphatic or aromatic (including mononuclear or polynuclear aromatics). Exemplary polyols include carbohydrates (such as saccharides), glycols (such as glycerin), and derivatives thereof (such as sugar alcohols). Monosaccharides suitable for use herein include, but are not limited to, mannose, galactose, arabinose, xylose, ribose, apiose, rhamnose, psicose, fructose, sorbose, tagitose, ribulose, xylulose, glucose, and erythrulose. Oligosaccharides suitable for use herein include, but are not limited to, maltose, kojibiose, nigerose, cellobiose, lactose, melibiose, gentiobiose, turanose, rutinose, trehalose, sucrose and raffinose. Polysaccharides suitable for use herein include, but are not limited to, amylose, glycogen, cellulose, chitin, inulin, agarose, xylans, mannan and galactans. The sugar alcohols suitable for use herein include, but are not limited to, sorbitol, erythritol, arabitol, xylitol, threitol, pentaerythritol, mannitol and galactitol.

Also suitable for use herein are other classes of polyol-based materials include sugar ethers, alkoxylated polyols, such as polyethoxy glycerol, pentaerythritol and other polyols containing amines such as glucosamine.

These polyol-based materials have the ability to modify a fabric surface to provide fabric care benefits. The derivatization or functionalization of the polyol is designed to be effective for different fabric care applications. Examples of functionalization approaches may include, but not limited to, esterification, etherification, alkylation, amidation, amination and other linking chemistries.

Typical fabric care benefits may include, but are not limited to: enhancement of fabric feel such as softness, hand and comfort; reduce or resist wrinkling; ease of ironing; enhancement of fabric color; abrasion resistance; fabric shape retention (elasticity, non-shrinkage, non-elongation); static reduction; lint reduction; faster drying; whitening; stain repellency.

Polyol-based materials suitable for use herein may have the following general formula:

$$M(OH)_{w-s}Q_s$$

wherein $M(OH)_w$ is a polyol as defined above; the molecular weight of the polyol is from about 150 to about 50,000 daltons, preferably from about 150 to about 20,000 daltons, more preferably about 150 to about 5000 daltons;

Q is the substituents replacing one or more of the OH group of the polyol, Q is selected from the group consisting of —OC(O)$R^1$, —O$R^2$, —$R^3$, -L$R^4$, —X, —F, —Cl, —Br, and mixtures thereof; wherein $R^1$, $R^2$, $R^3$ and $R^4$ are moieties independently selected from C1-C22 alkyl or C1-C30 alkoxy, linear or branched, cyclic or acyclic, saturated or unsaturated, substituted or unsubstituted;

L is a linkage selected from O, S, N and P;

X is a 3 to 8-membered heterocyclic moiety having the heteroatom independently selected from O, N, S, P, and Si;

w is an integer selected from 2 to 1000, preferably from 2 to 500, more preferably from 2 to 100 and most preferably from 2 to 20; and s is an integer equal to or smaller than w.

In one embodiment, the polyol-based fabric care material comprises a sucrose ester, which is composed of a sucrose molecule with one or more of the hydroxyl groups derivatized to an ester moiety. Sucrose is a disaccharide having the following formula:

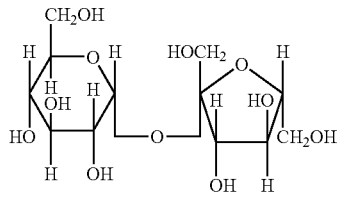

Alternatively, the sucrose molecule can be represented by the formula: $M(OH)_8$, wherein M represents the disaccharide backbone and there are total of 8 hydroxyl groups in the molecule. Thus, sucrose ester can be represented by the following formula:

$$M(OH)_{8-x}(OC(O)R^1)_x$$

wherein $R^1$ moieties are independently selected from C1-C22 alkyl or C1-C30 alkoxy, linear or branched, cyclic or acyclic, saturated or unsaturated, substituted or unsubstituted; and x is the number of esterified hydroxyl groups and (8-x) is the number of unmodified hydroxyl groups; thus, x is an integer selected from 1 to 8, or from 2 to 8, or from 3 to 8, or from 4 to 8.

In one embodiment, the $R^1$ moieties comprise linear alkyl or alkoxy moieties having independently selected and varying chain length. For example, $R^1$ may comprise a mixture of linear alkyl or alkoxy moieties wherein greater than about 20% of the linear chains are C18, or greater than about 50% of the linear chains are C18, or greater than about 80% of the linear chains are C18.

In another embodiment, the $R^1$ moieties comprise a mixture of saturate and unsaturated alkyl or alkoxy moieties; the degree of unsaturation can be measured by "Iodine Value" (hereinafter referred as "IV", as measured by the standard AOCS method). The IV of the polyol-based fabric care material suitable for use herein ranges from about 1 to about 150, or from about 5 to about 100, or from about 30 to about 85.

In another embodiment, The $R^1$ moieties may be hydrogenated to reduce the degree of unsaturation. It is believed that lower unsaturation or lower IV reduces yellowing of the fabric articles treated with polyol-based fabric care materials. The typical method for reducing the unsaturation is hydrogenation under applied heat, pressure or both. Exemplary hydrogenation methods are described in U.S. Pat. Nos. 4,806,632; 5,360,920; and references disclosed therein. These methods may lower the IV by from about 2 to about 15, preferably from about 5 to about 10.

In another embodiment, the unsaturated $R^1$ moieties may comprise a mixture of cis- and trans-forms about the unsaturated bonds. The cis/trans ratios may range from about 1:1 to about 50:1, or from about 2:1 to about 40:1, or from about 3:1 to about 30:1, or from about 4:1 to about 20:1.

The polyol-based fabric care materials are present in the fabric treatment composition of the present invention at levels from about 1% to about 70%, or from about 2% to about 50%, or from about 3% to about 30%, by weight of the composition.

Deposition Agents

It is generally believed that deposition of nonionic fabric care materials is not sensitive to the carry-over of anionic detergent components since there are no strong ionic interactions of opposite-charged species, we are surprised to discover that combining the nonionic fabric care materials described herein with certain deposition agents that are capable of interacting (via ionic or dipolar interactions) with the anionic species significantly improve the deposition of nonionic fabric care materials and imparts better fabric care benefits to the treated fabrics.

Suitable deposition agents include, but are not limited to (I) non-quaternary materials which are (a) acyclic polymers or copolymers having nitrogen moieties in the backbone or in the pendant groups, or (b) vinyl polymers or copolymers having nitrogen heterocyclics in the pendant groups; (II) non-polysaccharide polyquaterniums and other polymeric cationic quaternary materials; and mixtures thereof.

The deposition agents suitable for use herein are polymeric materials having a weight average molecular weight generally in the range from about 1000 to about 1,000,000 daltons, or from about 1000 to about 200,000 daltons, or from about 2500 to about 1,000,000 daltons, or from about 5000 to about 500,000 daltons. In some embodiments, the deposition agent is polyacrylamide or derivatives thereof, the weight average molecular weight of the deposition agent is from about 1,000,000 to about 15,000,000 daltons.

When present, each deposition agent comprises, based on total composition weight, at one of the following levels, from about 0.1% to about 20%, preferably from about 0.2% to about 15%, more preferably from about 0.2% to about 10 wt %, and most preferably from about 0.2% to about 5%.

In some embodiments of the present invention, suitable deposition agents are acyclic polymers or copolymers derived from monomers having nitrogen moieties, including but not limited to, amine, imine, amide, imide, acrylamide, methacrylamide, amino acid, and mixtures thereof. Nonlimiting examples of suitable deposition agents are described below:

Acyclic Polymers or Copolymers Having Nitrogen Moieties a) Polyvinylamine (PVAm)

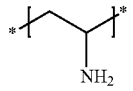

Examples of this polymeric material are available as Catiofast® PR8085, PR8106, PR8134, all of which are from BASF and are typically used as cross-linking agents or flocculating agents in paper-making industry.

b) Polyethyleneimine (PEI)

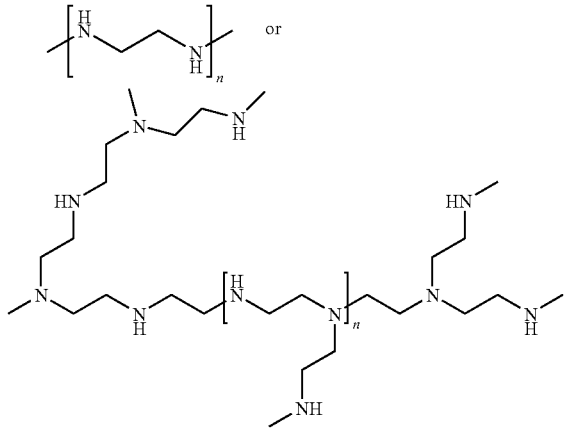

Examples of this polymeric material are available as Lupasol® and Polymin® from BASF, or as Catiofast® PL, SF, GM, PR8138, all of which are from BASF and are typically used as cross-linking agents or flocculating agents in paper-making industry.

c) Grafted and Crosslinked PolyAmido-Polyethyleneimine

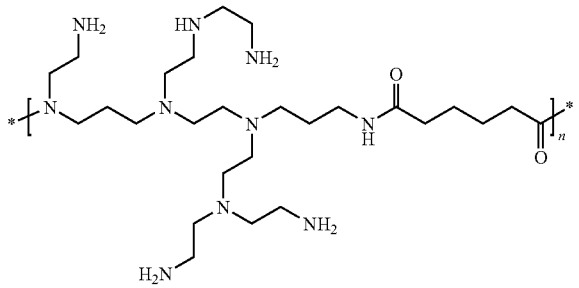

d) Ethoxylated Polyethyleneimine (PEI-E)

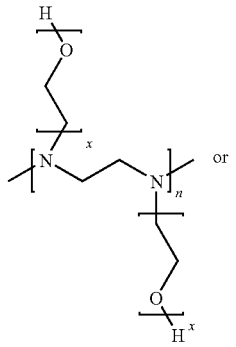

-continued

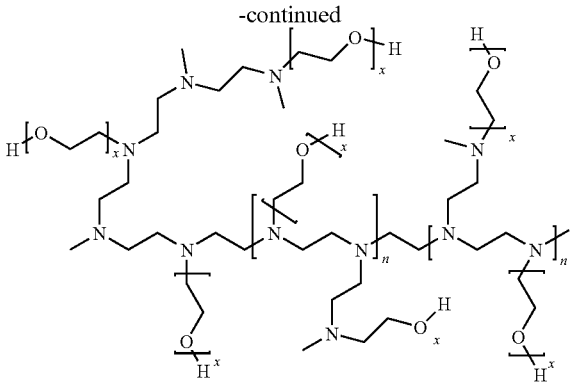

wherein, x=140 e) Polyacrylamide

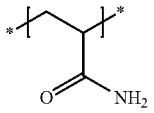

f) Poly(2-dimethylaminoethyl methacrylate)

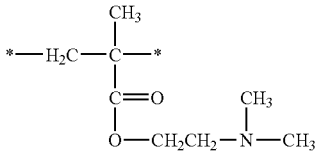

g) Poly(amino acids): for example, polylysine would have the following formula:

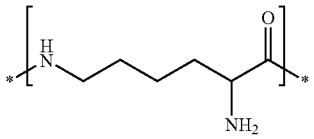

additional examples of poly(amino acids) are selected from the group consisting of:

(1) homo-condensates of basic amino acids, said amino acids selected from the group consisting of lysine, ornithine, arginine, and tryptophan;

(2) co-condensates of basic amino acids, said amino acids selected from the group consisting of lysine, ornithine, arginine, and tryptophan;

(3) co-polymers produced from the reaction of one or more basic amino acids with one or more co-condensable compounds;

(4) co-polymers produced from the reaction of one or more homo-condensates from (1) or co-condensates from (2) with one or more co-condensable compounds;

(5) crosslinked basic amino acid-containing polymers, said crosslinked polymers comprising:

i) one or more basic amino acids;

ii) co-polymers of (i) and one or more co-condensable compounds;

iii) optionally co-polymers produced from the reaction of one or more homo-condensates from (1) or co-condensates from (2) with one or more co-condensable compounds; and iv) one or more crosslinking unit;

wherein at least one crosslinking unit is derived from a crosslinker which comprises at least two functional groups;

(6) co-condensates formed from the reaction of one or more compounds selected from the group consisting of:

i) basic amino acids;

ii) co-condensable compounds;

iii) crosslinking agents; and (7) mixtures thereof.

h) Polylysine Aminocaproic Acid Derivatives

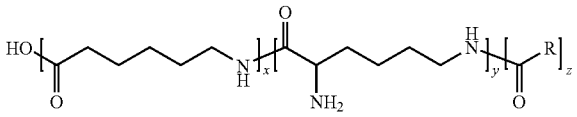

X = # of Caproic unit
Y = # of Lysine unit
Z = # Acid unit

R: CH3 (Acetic)
CH2CH3 (Propionic)

Vinyl Polymers or Copolymers Having Nitrogen Heterocyclic Pendant Moieties

In some embodiments of the present invention, suitable deposition agents are vinyl polymers or copolymers derived from vinyl monomers having nitrogen heterocyclic pendant moieties having the formula:

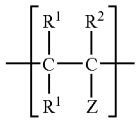

wherein $R^1$, $R^2$ are independently hydrogen, halogen, linear or cyclic, saturated or unsaturated C1-C4 alky or alkoxy, substituted or unsubstituted phenyl, benzyl, naphthayl or heterocyclics, and mixtures thereof; Z is nitrogen heterocyclics, including nitrogen heterocyclic N-oxides.

Nonlimiting examples of these deposition agents are described below:

a) Polyvinylpyrrolidone (PVP)

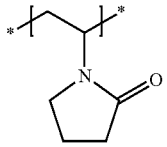

b) Polyvinylpyridine

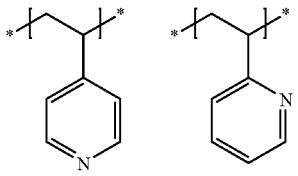

c) Polyvinylpyridine-N-oxide (PVNO)

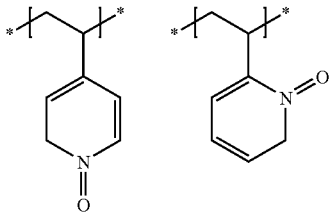

d) Polyvinylpyrrolidone Vinyl Imadazole (PVPVI)

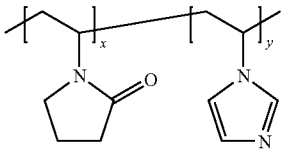

e) Copolymers of vinylpyrrolidone and dimethylaminoethyl methacrylate

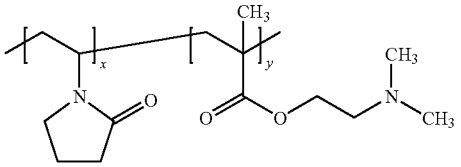

Non-polysaccharide Polyquaterniums and Other Polymeric Cationic Quaternary Materials In some embodiments of the present invention, suitable deposition agents are non-polysaccharide polyquaterniums, other polymeric catoinic quaternary materials or mixtures thereof. As used herein, the term "polyquaternium-x" has the same meaning as that of INCI (International Nomenclature Cosmetic Ingredient). These cationic quaternary materials can be paired with anions, including but not limited to halogen or $SO_3CH_3^-$. Nonlimiting examples of these deposition agents are described below:

a) Polyquaternium-2:

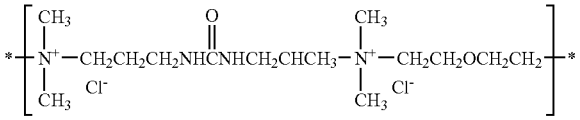

Examples of this polymeric material are available as Mirapol® A-15 (from Rhodia)

b) Polyquaternium-6: N,N-Dimethyl-N-2-propen-1-ammonium chloride homopolymer (PDADMAC)

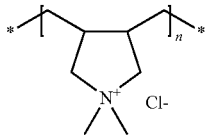

Examples of this polymeric material are available as Merquat® 100 (from Calgon), Percol® 370 or Magnafloc® 370 (from CIBA)

c) Polyquaternium-7: Copolymer of acrylamide and N,N-Dimethyl-N-2-propen-1-ammonium chloride

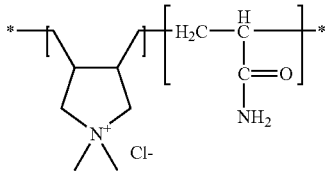

Examples of this polymeric material are available as Merquat® 550 (from Calgon) or Mirapol® 550 (from Rhodia)

d) Polyquaternium-11: Quaternized Poly(vinylpyrrolidone/Dimethylaminoethyl Acrylate

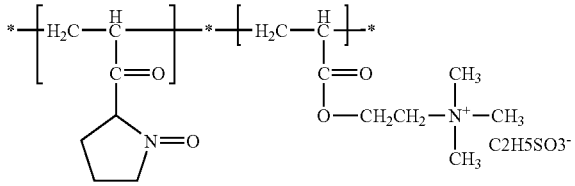

Examples of this polymeric material are available as Gafquat® 755, 755N, 734 (from ISP)

e) Polyquatemium-16: Copolymer of Polyvinylpyrrolidone and imidazolinium methochloride

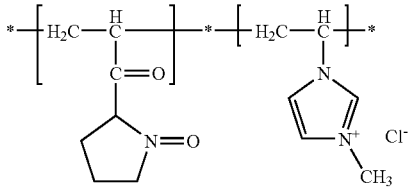

Examples of this polymeric material are available as Luviquat® FC and Luviquat® HM (from BASF).

f) Polyquaternium-17: examples of this polymeric material are available as Mirapol® AD-1 (from Rhodia)

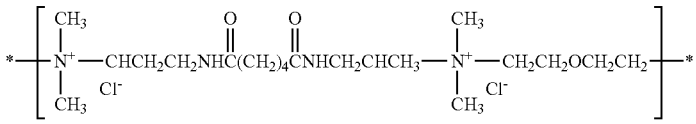

g) Polyquatemium-18: examples of this polymeric material are available as Mirapol® AZ-1 (from Rhodia)

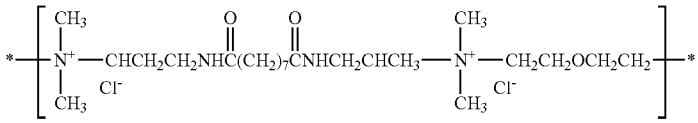

h) Polyquaternium-22: Copolymer of sodium acrylate and dimethyl diallyl ammonium chloride

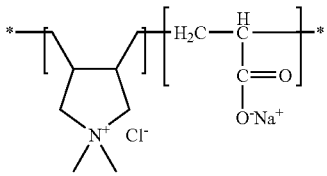

Examples of this polymeric material are available as Merquat® 280 and 295 (Calgon).

i) Polyquaternium-28: Copolymer of vinylpyrrolidone and methacrylate amidopropyl/trimethylammonium Chloride

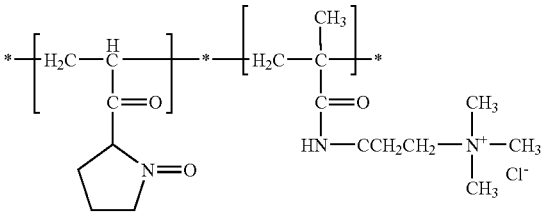

Examples of this polymeric material are available as Gafquat® HS-100 (ISP)

j) Cationic polyacrylamide such as polyacrylamide ethyl trimethylammonium cation

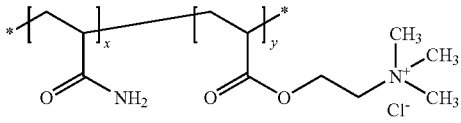

Examples of this polymeric material are available as Sedipur® CF (from BASF) wherein the cation is paired with a chloride anion.

k) Poly(2-acryloyloxyethyl)trimethylammonium cation, which may be paired with anion such as methylsulfate.

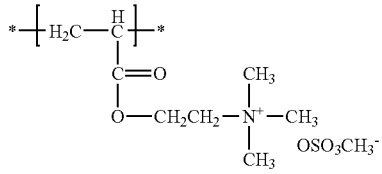

l) Polymethacrylamidopropyl trimethylammonium cation

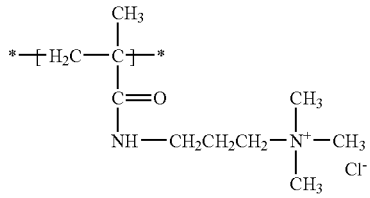

Examples of this polymeric material are available as Polycare® 133 (from Rhodia), wherein the cation is paired with a chloride anion.

m) Copolymers which contain polyamide, polyether and polyethylenimine, such as:

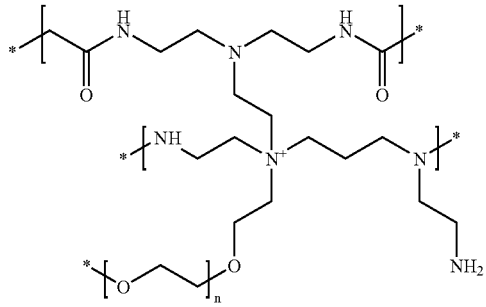

Examples of this polymeric material are available as Polymin® from BASF.

Dispersing Medium

The fabric treatment composition of the present invention also comprises a dispersing medium. Suitable dispersing medium include, but are not limited to, water, water soluble solvents selected from the group consisting of C4 to C10 glycol ethers, C2 to C7 glycols, polyethers, such as glycerin, and mixtures thereof.

The fabric treatment composition may comprise, based on weight percent of the composition, from about 30 wt % to about 99 wt %, from about 40 wt % to about 90 wt %, or from about 50 wt % to about 70 wt % of the dispersing medium. Typically, water comprises greater than about 30 wt %, or greater than about 60 wt % of the composition; the balance of the dispersing medium comprises water-soluble or water-dispersible solvents.

When fabric treatment composition comprises water, the pH of said composition may be in the range of from about 2 to about 10, from about 3 to about 9, from about 4 to about 8, or from about 5.5 to about 7.5. Commonly known pH buffers, such as those disclosed below in the "Adjunct materials", can be used to adjust and/or control the pH of the composition.

The present compositions can optionally further comprise solvents. Suitable solvents can be water-soluble or water-dispersible and can include ethanol, propanol, isopropanol, n-butanol, t-butanol, propylene glycol, ethylene glycol, dipropylene glycol, propylene carbonate, butyl carbitol, phenylethyl alcohol, 2-methyl 1,3-propanediol, hexylene glycol, glycerol, polyethylene glycol, 1,2-hexanediol, 1,2-pentanediol, 1,2-butanediol, 1,4-cyclohexanediol, pinacol, 1,5-hexanediol, 1,6-hexanediol, 2,4-dimethyl-2,4-pentanediol, 2,2,4-trimethyl-1,3-pentanediol, 2-ethyl-1,3-hexanediol, phenoxyethanol, or mixtures thereof. Solvents are typically incorporated in the present compositions at a level of less than about 20%, preferably less than 10% by weight of the composition. Preferred solvents, especially for clear compositions herein, have a ClogP of from about −2.0 to about 2.6, preferably from about −1.7 to about 1.6, and more preferably from about −1.0 to about 1.0, which are described in detail in U.S. application Ser. No. 09/554,969, filed Nov. 24, 1998 by Frankenbach et al. (WO 99/27050).

Adjunct Materials

The fabric treatment composition may also comprise optional adjunct materials. Adjunct materials include, but are not limited to, perfumes, wetting agents, emulsifiers, emulsion stabilizing agents, viscosity modifiers, pH buffers, antibacterial agents, antioxidants, radical scavengers, chelants, antifoaming agents, and mixtures thereof.

Except where noted otherwise, each adjunct material is optionally present, based on total composition weight, at the following levels, no more than about 30 wt %, or no more than about 20 wt %, or no more than about 10 wt %; and greater than about 0.01 wt %, or greater than about 0.1 wt %, or greater than about 1 wt %.

The composition of the present invention may optionally comprise one or more fabric care materials. These fabric care material provides one or more fabric benefits including, but not limited to, fabric softening, fabric lubrication, fabric relaxation, durable press, wrinkle resistance, wrinkle reduction, ease of ironing, abrasion resistance, fabric smoothing, anti-felting, anti-pilling, crispness, appearance enhancement, appearance rejuvenation, color protection, color rejuvenation, anti-shrinkage, in-wear shape retention, fabric elasticity, fabric tensile strength, fabric tear strength, static reduction, water absorbency or repellency, stain repellency, refreshing, anti-microbial, odor resistance, and mixtures thereof. Representative and nonlimiting examples of some fabric care materials are described below.

a. Softening Agents

Exemplary softening agents include, but are not limited to, diester quaternary ammonium compounds (DEQA); polyquaternary ammonium compounds; triethanolamine esterified with carboxylic acid and quaternized (so called "esterquat"); amino esterquats; cationic diesters; betaine esters; betaines; amine oxides; and mixtures thereof. More detailed descriptions of these and other softening agents are disclosed in GB 808,265; GB 1,161,552; DE 4,203,489; EP 221,855; EP 503,155; EP 507,003; EP 803,498; FR 2,523,606; JP 84-273918; JP 2-011545; U.S. Pat. Nos. 3,079,436; 4,418,054; 4,721,512; 4,728,337; 4,906,413; 5,194,667; 5,235,082; 5,670,472; 5,747,443; 5,759,990; 6,323,172; 6,369,025; 6,486,121; and WO 99/27050.

Nonlimiting examples of quaternaty ammonium type softeners may be selected from the group consisting of: N,N-dimethyl-N,N-di(tallowyloxyethyl) ammonium methylsulfate, N-methyl-N-hydroxyethyl-N,N-di(canoyloxyethyl) ammonium methylsulfate, N,N-ditallow N,N-dimethyl ammonium chloride, N,N-ditallowylethanol N,N-dimethyl ammonium chloride, and mixtures thereof. These and other quaternary ammonium type softeners are commercially available under the tradenames Adogen®, Reweoquat®, Varisoft® (all are available from Degussa) and Armosoft® (from Akzo)

Additional examples of non-silicone fabric softening agents and deposition agents are disclosed in EP 902 009; WO 99/58492; U.S. Pat. No. 4,137,180; WO 97/08284; WO 00/70004; WO 00/70005; WO 01/46361; WO 01/46363; WO 99/64661; WO 99/64660; JP 11-350349; JP 11-081134; and JP 11-043863.

Some of the softening agents are described in details below. Suitable protonatable amines include protonatable amines having Formula I below:

Formula I $$(R)_{3-m}-N-[(CH_2)_n-Q-R^1]_m$$

wherein the index m=0, 1, 2 or 3; the index n=1, 2, 3 or 4, preferably n is 2 or 3, more preferably n is 2, each R is independently selected from $C_1$-$C_{22}$ alkyl, $C_1$-$C_{22}$ hydroxyalkyl or a benzyl group; each $R^1$ is independently selected from $C_{11}$-$C_{22}$ linear alkyl, $C_{11}$-$C_{22}$ branched alkyl, $C_{11}$-$C_{22}$ linear alkenyl, or $C_{11}$-$C_{22}$ branched alkenyl; and each Q may comprise a carbonyl, carboxyl, or amide moiety.

Suitable alkylated quaternary ammonium compounds (quats), include mono-alkyl quats, di-alkyl, tri-alkyl quats and tetra-alkyl quats and certain cationic surfactants. Suitable mono-alkyl quats, di-alkyl, tri-alkyl quats and tetra-alkyl quats typically have Formula II below:

Formula II $$\left[(R)_{4-m}-\overset{+}{N}-[(CH_2)_n-Q-R^1]_m\right]\ X^-$$

wherein the index m=0, 1, 2, 3 or 4; the index n=1, 2, 3 or 4, preferably n is 2 or 3, more preferably n is 2, each R is independently selected from $C_1$-$C_{22}$ alkyl, $C_1$-$C_{22}$ hydroxyalkyl, or a benzyl group; each $R^1$ is independently selected from $C_{11}$-$C_{22}$ linear alkyl, $C_{11}$-$C_{22}$ branched alkyl, $C_{11}$-$C_{22}$ linear alkenyl, or $C_{11}$-$C_{22}$ branched alkenyl; $X^-$ is a water soluble anionic species such as chloride, bromide or methyl sulfate, and Q may comprise a carbonyl, carboxyl, or amide moiety.

Cationic surfactants, such as quaternary ammonium surfactants, are also suitable for use herein as the softening agents. Suitable quaternary ammonium surfactants can be selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Another preferred cationic surfactant is $C_6$-$C_{18}$ alkyl or alkenyl ester of an quaternary ammonium alcohol, such as quaternary choline esters. More preferably, the cationic surfactants have Formula III below:

Formula III

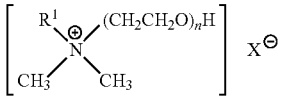

wherein $R^1$ is a $C_8$-$C_{18}$ hydrocarbyl, preferably $C_{8-14}$ alkyl, more preferably $C_8$, $C_{10}$ or $C_{12}$ alkyl, and $X^-$ is a water soluble anionic species such as chloride, bromide or methyl sulfate.

Other suitable fabric softening materials may be polymeric materials such as polyacrylates, polyvinylalcohols, polyethyleneglycols, and derivatives or copolymers of the aforementioned materials.

b. Emulsifiers

Optionally, the composition comprises from about 0% to about 5%, or from about 0.01% to about 2%, or from about 0.05% to about 1% by weight of the composition, of an emulsifier.

In some embodiments, emulsifiers in the composition are selected from the group consisting of nonionic surfactants, cationic surfactants, and mixtures thereof. In other embodiments, emulsifiers in the composition include amine oxides, alkyl polyglucosides, cetyltrimethyl ammonium chloride, alkyl sulfates, alkyl sulfonates, alkyl ethoxylates, alkyl ethoxy sulfates, and mixtures thereof.

Suitable nonionic surfactants include certain surfactants produced by the condensation of alkylene oxide groups with an organic hydrophobic moiety, said moiety can be aliphatic or alkyl aromatic in nature; silicone copolyols; and mixtures thereof. Examples of suitable nonionic surfactants include, but are not limited to alkyl phenol ethoxylates, polyethylene glycol/polypropylene glycol block copolymers, fatty alcohol and fatty acid ethoxylates, long chain tertiary amine oxides, alkyl polysaccharide, polyethylene glycol (PEG) glyceryl fatty esters and mixtures thereof.

Other examples of ethoxylated surfactant suitable for use herein include, but are not limited to, alkyl ethoxylates, carboxylated alcohol ethoxylates; ethoxylated quaternary ammonium surfactants; and ethoxylated alkyl amines. Nonlimiting examples of ethoxylated surfactants are:

a) $C_9$-$C_{18}$ alkyl ethoxylates, such as NEODOL® nonionic surfactants from Shell;

b) $C_6$-$C_{18}$ alkyl ethoxylates, such as TERGITOL® nonionic surfactants from Dow Chemical;

c) $C_6$-$C_{12}$ alkyl phenol alkoxylates wherein the alkoxylate units are a mixture of ethyleneoxy and propyleneoxy units;

d) $C_{12}$-$C_{18}$ alcohol and $C_6$-$C_{12}$ alkyl phenol condensates with ethylene oxide/propylene oxide block polymers such as PLURONIC® from BASF;

e) $C_{14}$-$C_{22}$ mid-chain branched alcohols, BA, as discussed in U.S. Pat. No. 6,150,322;

f) $C_{14}$-$C_{22}$ mid-chain branched alkyl alkoxylates, $BAE_x$, wherein x 1-30, as discussed in U.S. Pat. No. 6,153,577, U.S. Pat. No. 6,020,303 and U.S. Pat. No. 6,093,856;

g) ether capped poly(oxyalkylated) alcohol surfactants as discussed in U.S. Pat. No. 6,482,994, WO 01/42408, and WO 01/42408; and h) fatty acid ($C_{12}$-$_{18}$) sorbitan esters, SPAN®, and their ethoxylated ($EO_{5-100}$) derivatives, polysorbates; such as SPAN®20, TWEEN® 20, TWEEN® 60, TWEEN® 80 (commercially available from Uniqema).

Other examples of ethoxylated surfactant include carboxylated alcohol ethoxylates; ethoxylated quaternary ammonium surfactants; and ethoxylated alkyl amines.

Suitable cationic surfactants include, but are not limited to quaternary ammonium surfactants, which can have up to 26 carbon atoms.

a) alkoxylate quaternary ammonium (AQA) surfactants as discussed in U.S. Pat. No. 6,136,769;

b) dimethyl hydroxyethyl quaternary ammonium as discussed in U.S. Pat. No. 6,004,922;

c) polyamine cationic surfactants as discussed in WO 98/35002, WO 98/35003, WO 98/35004, WO 98/35005, and WO 98/35006;

d) cationic ester surfactants as discussed in U.S. Pat. Nos. 4,228,042, 4,239,660, 4,260,529 and U.S. Pat. No. 6,022,844; and e) amino surfactants as discussed in U.S. Pat. No. 6,221,825 and WO 00/47708, specifically amido propyldimethyl amine.

c. Emulsion Stabilizing Agents

Optionally, the composition comprises from about 0% to about 10%, or from about 0.1% to about 5%, or from about 0.5% to about 2% by weight of the composition, of an emulsion stabilizing agent.

In some embodiments, the emulsion stabilizing agents include, but are not limited to, ethoxylated terepthalate, arabinogalactan, ethoxylated polyethylene imines, and mixtures thereof. In other embodiments, the emulsion stabilizing agents include, but are not limited to copolymeric blocks of terephthalate and polyethylene oxide or polypropylene oxide, and the like. Additional suitable emulsion stabilizing agents are described in more detail in U.S. Pat. Nos. 5,574,179 and 4,702,857. Examples of these emulsion stabilizing agents include the commercially available materials ZELCON® 4780 (from DuPont) and MILEASE® T (from ICI). Suitable emulsion stabilizing agents may also contain cationic functionalities, such as those disclosed in U.S. Pat. No. 4,956,447.

d. Other Adjunct Ingredients

Nonlimiting examples of viscosity modifiers include salts, such as $CaCl_2$, $MgCl_2$, NaCl, guar gum, polysaccharides, and mixtures thereof. Other salts containing and other alkali or alkaline earth metal cations and halide anions, and the like, are also suitable.

Nonlimiting examples of pH buffers include citric acid, lactic acid, succinic acid, phosphoric acid, sodium bicarbonate, and mixtures thereof.

The antibacterial agents include didecyl dimethyl ammonium chloride, which is available under the tradename Uniquat® (from Lonza), 1,2-benzisothiozolin-3-one, which is available under the tradename Proxel® (from Zeneca Inc.), dimethylol-5,5-dimethylhydantoin, which is available under the tradename Dantoguard® (from Lonza) and 5-Chloro-2-methyl-4-isothiazolin-3-one/2-methyl-4-isothiazolin-3-one, which is available under the tradename Kathon® (from Rohm and Haas).

The antioxidants include, but are not limited to tocopherol acetates, quinines, polyphenols, and mixtures thereof.

The radical scavengers include, but are not limited to propyl gallate, polyimines, trimethoxy benzoic acid and mixtures thereof.

The chelants include, but are not limited to diethylene triamine pentaacetic acid, ethylene diamine teraacetic acid, diethylene triamine pentamethylethylene phosphomic acid, citric acid and mixtures thereof.

The antifoaming agent include, but are not limited to silicone oils, ethoxylated surfactants, Tetronics® (available from BASF), and mixtures thereof.

The perfume materials may be obtained from one or more of the following perfume material suppliers Firmenich (Geneva, Switzerland), Givaudan (Argenteuil, France), IFF (Hazlet, N.J.), Quest (Mount Olive, N.J.), Bedoukian (Danbury, Conn.), Sigma Aldrich (St. Louis, Mo.), Millennium Specialty Chemicals (Olympia Fields, Ill.), Polarone International (Jersey City, N.J.), Fragrance Resources (Keyport, N.J.), and Aroma & Flavor Specialties (Danbury, Conn.).

Suitable particulate materials include inorganic or organic particulates such as polymeric particles, clays, talcs, zeolites and mixtures thereof. Suitable polymeric particles typically have an average particle size less than about 10 microns, preferably less than 5 microns, more preferably less than about 1 micron. Such particles may comprise polyethylene, polystyrene, polypropylene and mixtures thereof. Suitable clay materials include phyllosilicate clays with a 2:1 layer structure, such as smectite clays for example pyrophyllite, montmorillonite, hectorite, saponite and vermiculite, and micas. Particularly suitable clay materials include smectite clays described in U.S. Pat. No. 4,062,647. Other disclosures of suitable clay materials for fabric softening purposes include European patent specification EP 26528-A1, U.S. Pat. Nos. 3,959,155 and 3,936,537.

Other suitable adjunct materials include, but are note limited to, preservatives such as benzyl alcohol, methyl paraben, propyl paraben and imidazolidinyl urea; suspending agents such as magnesium/aluminum silicate; sequestering agents such as disodium ethylenediamine tetraacetate; and certain synthetic or naturally-derived oils and/or fats, such as certain triglycerides, mineral oils, and mixtures thereof. Specific examples of oils or fats suitable for use herein as adjunct materials include but are not limited to; triglycerides from beef tallow, palm oil, cottonseed oil, canola oil, and soybean oil, all with varying levels of hydrogenation; paraffin oils, and mixtures thereof.

Additional adjunct materials further include, but are not limited to, wrinkle releasing/prevention agent, anti-static agent, crystal modifier, soil release/prevention agent, colorant, brightener, odor reducer/eliminator, deodorizer/refresher agent, stain repellent, color enhancer, perfume release and/or delivery agent, shape retention agent, fiber rebuild agent, fiber repair agent, and mixtures thereof.

Additional examples of suitable adjuncts and levels of use are found in U.S. Pat. No. 6,653,275.

Suitable adjunct materials are commercially available from Mazer Chemicals (Gurnee, Ill., USA), Clariant Corporation (Glattbrugg, Switzerland), Rhodia Incorporated (Cranbury, N.J., USA), Scher Chemicals, Inc. (Clifton, N.J., USA), Dow Corning Corporation (Midland, Mich., USA) and General Electric Company (Fairfield, Conn., USA), Witco Corporation (Middlebury, Conn., USA), Degussa-Huls (Marl, Germany), BASF (Mount Olive, N.J., USA), Sigma-Aldrich (St. Louis, Mo., USA), 20 Microns Ltd. (Baroda, India), and Twin Rivers Technologies (Quincy, Mass., USA).

EXAMPLES

The following compositions are examples of fabric treatment compositions, comprising polyol based fabric care materials and deposition polymer, useful in the present invention:

| | Component | | | | | | | |
|---|---|---|---|---|---|---|---|---|
| | A | B | C | D | E | F | G | H |
| Sucrose fatty ester-1 [a] | 14 | 14 | 14 | 28 | 0 | 0 | 0 | |
| Sucrose fatty ester-2 [b] | 0 | 0 | 0 | 0 | 14 | 16 | 20 | 28 |
| CTMAC [c] | 3.5 | 2 | 1 | 7.0 | 2.5 | 4 | 4 | 3 |
| Tergitol ® TMN-6 [d] | 0 | 2 | 3 | 0 | 0 | 0 | 0 | 4 |
| Deposition agent-1 [e] | 3 | 0 | 0 | 2 | 2 | 0 | 0 | 1 |
| Deposition agent-2 [f] | 0 | 3 | 0 | 0 | 0 | 2 | 0 | 0 |
| Deposition agent-3 [g] | 0 | 0 | 3 | 0 | 0 | 0 | 3 | 0 |
| Deposition agent-4 [h] | 0 | 0 | 0 | 1 | 0 | 0 | 0 | 2 |
| Lactic acid | 0.5 | 0.5 | 0.5 | 0.5 | 0.5 | 0.5 | 0.5 | 0.5 |
| Proxel ® [i] | 0.1 | 0.1 | 0.1 | 0.1 | 0.1 | 0.1 | 0.1 | 0.1 |
| Dantoguard ® [j] | 0.15 | 0.15 | 0.15 | 0.15 | 0.15 | 0.15 | 0.15 | 0.15 |
| TMBA [k] | 0.05 | 0.05 | 0.05 | 0.05 | 0.05 | 0.05 | 0.05 | 0.05 |
| DTPA [l] | 0.05 | 0.05 | 0.05 | 0.05 | 0.05 | 0.05 | 0.05 | 0.05 |
| Water | Bal. | Bal. | Bal. | Bal. | Bal. | Bal. | Bal. | Bal. |
| TOTAL | 100 | 100 | 100 | 100 | 100 | 100 | 100 | 100 |

[a] Sucrose fatty ester-1 = sucrose fatty ester derived from soy bean oil with average esterification of 7.5 on each sucrose.
[b] Sucrose fatty ester-2 = sucrose fatty ester derived from soy bean oil with average esterification of 4 on each sucrose.
[c] CTMAC = Cetyl Trimethyl Ammonium Chloride.
[d] Nonionic surfactant derived from 2,6,8-trimethyl-4-nonanol with ethylene oxide.
[e] Polyvinylamine (PVAm) from BASF.
[f] Polyethyleneimine (PEI) from BASF.
[g] Polyquaternium-6: N,N-Dimethyl-N-2-propen-1-ammonium chloride homopolymer (PDADMAC) from Ciba.
[h] Cationic Polyacrylamide: Sedipur ® CF803 from BASF.
[i] Proxel ® = 1,2-Benzisothiozolin-3-one.
[j] Dantoguard ® = Dimethylol-5,5-Dimethylhydantoin.
[k] TMBA = Trimethoxy Benzoic Acid.
[l] DTPA = Sodium Diethylene Triamine Pentaacetate The following compositions are examples of fabric treatment compositions, comprising polyol based fabric care materials, deposition polymer, and adjunct fabric care materials, useful in the present invention:

| | Component | | | | | | | |
|---|---|---|---|---|---|---|---|---|
| | I | J | K | L | M | N | O | P |
| Sucrose fatty ester-1 [a] | 7 | 7 | 7 | 14 | 0 | 0 | 0 | 0 |
| Sucrose fatty ester-2 [b] | 0 | 0 | 0 | 0 | 7 | 7 | 7 | 14 |
| CTMAC [c] | 1.5 | 2 | 1 | 3 | 1.5 | 2 | 1 | 3 |
| DTDMAC [m] | 8 | 0 | 0 | 0 | 8 | 0 | 0 | 0 |
| DEEDMAC [n] | 0 | 8 | 16 | 0 | 0 | 8 | 16 | 0 |
| TEEMAMS [o] | 0 | 0 | 0 | 14 | 0 | 0 | 0 | 14 |
| Deposition agent-1 [p] | 2 | 2 | 0 | 1 | 2 | 2 | 0 | 1 |
| Deposition agent-2 [q] | 0 | 0 | 2 | 2 | 0 | 0 | 2 | 2 |
| Lactic acid | 0.5 | 0.5 | 0.5 | 0.5 | 0.5 | 0.5 | 0.5 | 0.5 |
| Proxel ® [i] | 0.1 | 0.1 | 0.1 | 0.1 | 0.1 | 0.1 | 0.1 | 0.1 |
| Dantoguard ® [j] | 0.15 | 0.15 | 0.15 | 0.15 | 0.15 | 0.15 | 0.15 | 0.15 |
| TMBA [k] | 0.05 | 0.05 | 0.05 | 0.05 | 0.05 | 0.05 | 0.05 | 0.05 |
| DTPA [l] | 0.05 | 0.05 | 0.05 | 0.05 | 0.05 | 0.05 | 0.05 | 0.05 |
| Water | Bal. | Bal. | Bal. | Bal. | Bal. | Bal. | Bal. | Bal. |
| TOTAL | 100 | 100 | 100 | 100 | 100 | 100 | 100 | 100 |

[a, b, c, i, j, k and l] are the same as the example above.
[m] DTDMAC = Di-Tallow Di-methyl Ammonium Chloride.
[n] DEEDMAC = Di-tallowoylethanolester dimethylammonium chloride.
[o] TEEMAMS = Triethanol amine ester methyl ammonium methylsulfate.
[p] Polyvinylamine (PVAm) from BASF.
[q] Polyethyleneimine (PEI) from BASF.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All documents cited are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric care composition consisting of:

(a) a polyol-based fabric care material;

(b) from about 0.1% to about 20% by weight of a deposition agent which is polyvinyl pyrrolidone vinyl imadazole the weight ratio of (a):(b) being from about 10:1 to about 2:1; and (c) water as a dispersing medium;

wherein the polyol-based fabric care material (a) has the following formula:

$$M(OH)_{w-s}Q_s$$

wherein $M(OH)_w$ is a polyol; the molecular weight of the polyol is from about 150 to about 50,000 daltons;

Q is a mixture of ester and ether substituents wherein said ester substituents are of the formula $OC(O)R^1$ and wherein said ether substituents are of the formula $R^3$, wherein $R^1$ is $C_1$-$C_{22}$ alkyl and wherein $R^3$ is $C_1$-$C_{30}$ alkoxy;

w is an integer selected from 2 to 1000; and s is an integer and s <w; and an adjunct material selected from the group consisting of:

(d) wetting agents; emulsifiers; emulsion stabilizing agents; viscosity modifiers; pH buffers; antibacterial agents; antioxidants; radical scavengers; chelants; anti-foaming agents; softening agents; perfumes; and mixtures thereof.

2. The composition of claim 1 wherein the composition consists of an amine oxide as an adjunct emulsifier material.

3. The composition of claim 2 wherein the composition further consists of additional adjunct materials selected from the group consisting of wrinkle releasing/prevention agent, anti-static agent, crystal modifier, soil release/prevention agent, colorant., brightener, odor reducer/eliminator, deodorizer/refresher agent, stain repellent, color enhancer, perfume release and/or delivery agent, shape retention agent, fiber rebuild agent, fiber repair agent, and mixtures thereof.

4. The composition of claim 1 wherein the composition consists of:

from about 1% to about 70% by weight of the composition of the polyol-based fabric care material (a); from about 0.1% to about 20% by weight of the composition of the deposition agent; (b) from about 30% to about 98% by weight of the composition of the dispersing medium; (c) and no more than about 30% by weight of the composition of the adjunct material (d).

5. The composition of claim 4 wherein the composition consists of an adjunct material selected from the group consisting of a softening agent, an emulsifier, a perfume, a viscosity modifier, and mixtures thereof.

6. The composition of claim 1 wherein the composition has a viscosity of from about 1 cps to about 2000 cps.

7. A process of treating fabric articles comprising the step of contacting fabric articles with the composition according to claim 1.

8. The process of claim 7 wherein the contacting step occurs during the wash cycle, the rinse cycle, the drying cycle, and combinations thereof.

9. An article of manufacture consisting of the composition according to claim 1 and a carrier substrate.

10. An article or manufacture consisting of the composition according to claim 1 and a water-soluble film.

11. An article of manufacture consisting of the composition according to claim 1 and an effective amount of a carrier material such that the article of manufacture has a melting temperature or a softening temperature above 95° C.

* * * * *